US009592670B2

(12) United States Patent
Obata et al.

(10) Patent No.: US 9,592,670 B2
(45) Date of Patent: Mar. 14, 2017

(54) LIQUID ACCOMMODATING CONTAINER, LIQUID EJECTING DEVICE AND LIQUID INTRODUCING METHOD

(71) Applicant: CANON FINETECH INC., Misato (JP)

(72) Inventors: Yuya Obata, Nagareyama (JP); Hiroyuki Ishinaga, Tokyo (JP); Kayo Mukai, Tokyo (JP)

(73) Assignee: CANON FINETECH INC., Misato-Shi (JP)

( * ) Notice: Subject to any disclaimer, the term of this patent is extended or adjusted under 35 U.S.C. 154(b) by 0 days.

(21) Appl. No.: 14/750,029

(22) Filed: Jun. 25, 2015

(65) Prior Publication Data

US 2015/0375511 A1 Dec. 31, 2015

(30) Foreign Application Priority Data

Jun. 30, 2014 (JP) ..... 2014-134817

(51) Int. Cl.
*B41J 2/165* (2006.01)
*B41J 2/175* (2006.01)

(52) U.S. Cl.
CPC ..... *B41J 2/16523* (2013.01); *B41J 2/175* (2013.01)

(58) Field of Classification Search
None
See application file for complete search history.

(56) References Cited

U.S. PATENT DOCUMENTS

| | | | | |
|---|---|---|---|---|
| 5,801,736 | A | 9/1998 | Ikkatai et al. | |
| 6,264,312 | B1 | 7/2001 | Koitabashi et al. | |
| 2004/0075702 | A1* | 4/2004 | Waller | B41J 2/16547 346/36 |
| 2007/0257974 | A1 | 11/2007 | Hatasa et al. | |
| 2009/0290002 | A1 | 11/2009 | Katoh | |
| 2010/0141722 | A1 | 6/2010 | Saito et al. | |
| 2010/0201765 | A1 | 8/2010 | Paku et al. | |

FOREIGN PATENT DOCUMENTS

| | | | |
|---|---|---|---|
| CN | 101746126 | A | 6/2010 |
| CN | 101804737 | A | 8/2010 |
| CN | 202491515 | U | 10/2012 |
| EP | 0781659 | A2 | 7/1997 |
| EP | 0781659 | A3 | 1/1999 |
| JP | 2000-141704 | A | 5/2000 |

(Continued)

OTHER PUBLICATIONS

Chinese Office Action issued in corresponding Chinese Application No. 201510373094.1 dated Jun. 14, 2016.

(Continued)

*Primary Examiner* — Alejandro Valencia
(74) *Attorney, Agent, or Firm* — Fitzpatrick, Cella, Harper & Scinto

(57) ABSTRACT

There are provided a liquid accommodating container that has a sufficient volume for reserving waste ink and can accommodate therein a sufficient amount of ink used in printing with space-saving, a liquid ejecting device provided therewith and a liquid introducing method. Therefore non-print ink is discharged and reserved in a portion, in which unused ink for printing was reserved, in an ink tank for replacement of the unused ink.

11 Claims, 13 Drawing Sheets

(56) References Cited

FOREIGN PATENT DOCUMENTS

| | | | |
|---|---|---|---|
| JP | 2002-52741 | A | 2/2002 |
| JP | 2002200773 | A | 7/2002 |
| JP | 2010-143070 | A | 7/2010 |
| JP | 2010-143071 | A | 7/2010 |
| JP | 2011-016303 | A | 1/2011 |

OTHER PUBLICATIONS

European Search Report issued in corresponding European Application No. 15174204.6 dated Jun. 22, 2016.

* cited by examiner

LIQUID ACCOMMODATING CONTAINER, LIQUID EJECTING DEVICE AND LIQUID INTRODUCING METHOD

BACKGROUND OF THE INVENTION

Field of the Invention

The present invention relates to a liquid accommodating container, a liquid ejecting device and a liquid introducing method that can be widely applied to an inkjet print head that can eject ink and an inkjet printing apparatus provided with the inkjet print head, for example.

Description of the Related Art

In a liquid ejecting device that ejects liquids (hereinafter called ink as well) from nozzles provided in a liquid ejecting head for printing, there are some cases where there occurs a defect that foreign particles such as paper powder or air bubbles enter into the nozzle to cause an ejection failure or disturbance of an image. In addition, when a liquid ejecting device is not used for a long period of time, viscosity as well as concentration of ink in the nozzle increase. The reason for this is that water components of the ink in the nozzle evaporate from the nozzle. In some cases the ink the viscosity of which has increased (thicker ink) causes clogging in the nozzle. When the thicker ink causes the clogging in the nozzle, there possibly occurs non-ejection that ink is not ejected from the nozzle.

Therefore for the purpose of removal of air bubbles and foreign particles in the nozzle, prevention of occurrence in clogging to be caused by the thicker ink and elimination of the occurred clogging, there is known a technology in regard to a recovery process of recovering the ink ejecting state back to an initial state by ejecting or forcibly sucking ink from the nozzle. The ink (waste ink) ejected or sucked in this recovery process is reserved through a recovery mechanism in a waste ink tank provided in the liquid ejecting device. In this case, when a capacity of the waste ink tank is small, the waste ink possibly leaks out of the waste ink tank. Therefore the waste ink tank needs to have a sufficient capacity. However, following a recent demand for downsizing the device (space-saving), it is difficult to dispose the waste ink tank having a sufficient capacity.

For this reason, Japanese Patent Laid-Open No. 2002-52741 discloses an inkjet printing apparatus provided with an ink tank that has an opening through which the waste ink ejected from a print head is received in the ink tank.

In addition, Japanese Patent Laid-Open No. 2000-141704 discloses a collection mechanism of causing the ink collected from a print head to be absorbed by an absorbing element in an ink tank.

However, in Japanese Patent Laid-Open No. 2002-52741 and Japanese Patent Laid-Open No. 2000-141704, the waste ink collected in the ink tank is mixed with ink having not been used for printing, which will be again used for printing. Since the waste ink becomes thicker in viscosity or contains foreign particles mixed therein, supply of the ink in which the waste ink is mixed to the print head possibly causes the clogging of the nozzle.

SUMMARY OF THE INVENTION

A liquid accommodating container according to the present invention is provided with a liquid absorbing element and supplies a first liquid absorbed in the liquid absorbing element from a supply opening to a liquid ejecting head, the liquid accommodating container comprising an introduction opening that is provided to introduce a second liquid not supplied to the liquid ejecting head to the liquid absorbing element, and a preventive unit that prevents the second liquid introduced to the liquid absorbing element through the introduction opening from being mixed with the first liquid.

Further features of the present invention will become apparent from the following description of exemplary embodiments (with reference to the attached drawings).

DESCRIPTION OF THE EMBODIMENTS

Hereinafter, an embodiment according to the present invention will be in detail described with reference to the accompanying drawings.

Figure 1A:
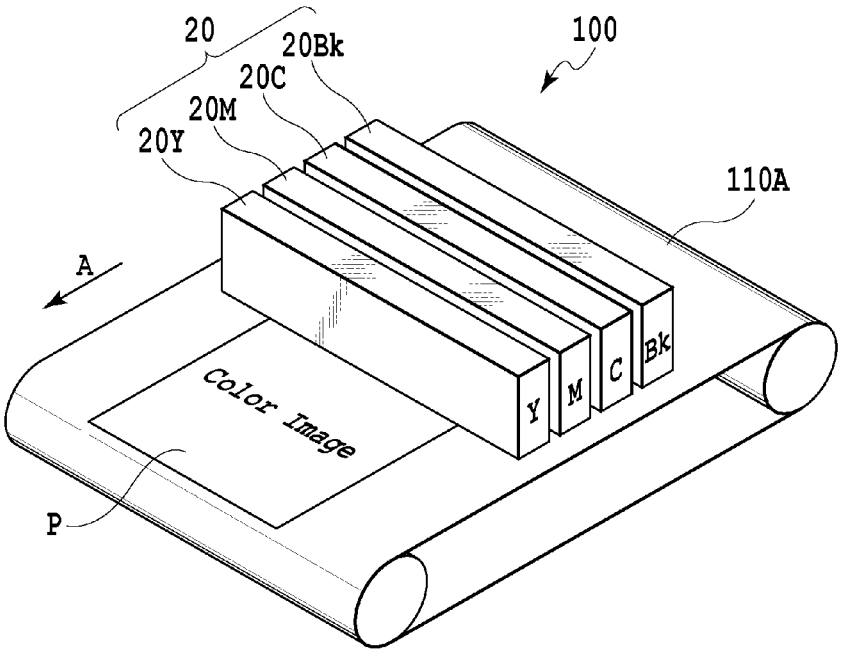
FIG. 1A is a diagram illustrating a schematic configuration of a printing apparatus provided with print heads as liquid ejecting heads in a first embodiment of the present invention.
Figure 1B:
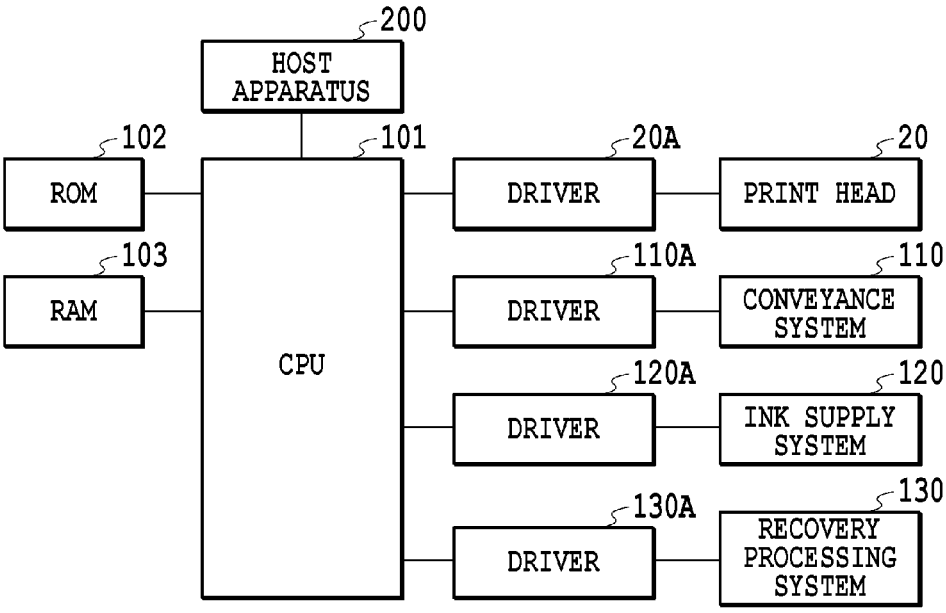
FIG. 1B is a block diagram illustrating a control system in the printing apparatus.

FIG. 1A is a perspective view illustrating an essential part for explaining a schematic configuration of an inkjet printing apparatus (liquid ejecting device) 100 to which the present invention is applicable. FIG. 1B is a block diagram illustrating a control system in the printing apparatus 100. The printing apparatus 100 is provided with an inkjet print head (liquid ejecting head) 20 as an embodiment of the liquid ejecting head in the present invention to eject ink (liquids).

The printing apparatus 100 in the present embodiment is a so-called full line type printing apparatus, and ejects ink from the print head 20 while successively conveying a print medium P in a direction of an arrow A by a conveyance system (conveyance mechanism) 110, thus making it possible to print an image on the print medium P. The conveyance system 110 in the present embodiment uses a conveyance belt 110A to convey the print medium P. However, the configuration of the conveyance system 110 is not limited, and a conveyance roller may be used to convey the print medium P. In a case of the present embodiment, the print head 20 comprises print heads 20Y, 20M, 20C and 20Bk that respectively eject yellow (Y), magenta (M), cyan (C) and black (Bk) supplied from an ink supply system (ink supply mechanism) 120 to be described later. This structure enables a color image to be printed on the print medium P.

The printing apparatus 100 is provided with a recovery processing system 130 that is used in a recovery process for appropriately maintaining an ejection state of ink in the print head 20. The recovery process may include a preliminary ejection operation for ejecting the ink that is not used for printing an image into a cap from an ejection opening, a pressurizing recovery operation for pressurizing the ink in the print head 20 to be forcibly discharged into the cap from the ejection opening, and the like. Further, the recovery process may include a suction recovery operation for sucking/discharging the ink into the cap from the ejection opening, a wiping operation for wiping an ejection opening face of the print head 20 on which the ejection opening is formed, and the like.

A CPU (control unit) 101 in the printing apparatus 100 executes control processing of operations, data processing and the like in the present printing apparatus. A ROM 102 stores therein a program of the processing procedure and the like, and a RAM 103 is used as a work area for executing the above processing. The CPU 101 controls the print head 20, the conveyance system 110, the ink supply system 120 and the recovery processing system 130 through drivers 20A, 110A, 120A and 130A corresponding to these. The CPU 101 ejects ink from the print head 20 based upon image data that is input from a host apparatus 200 such as a host computer, thus printing an image on the print medium P. The CPU 101 operates the print head 20, the conveyance system 110, the ink supply system 120, and the recovery processing system 130 to execute control of "at the cleaning time of the print head" and "at the supply starting time of ink", which will be described later.

Figure 2:
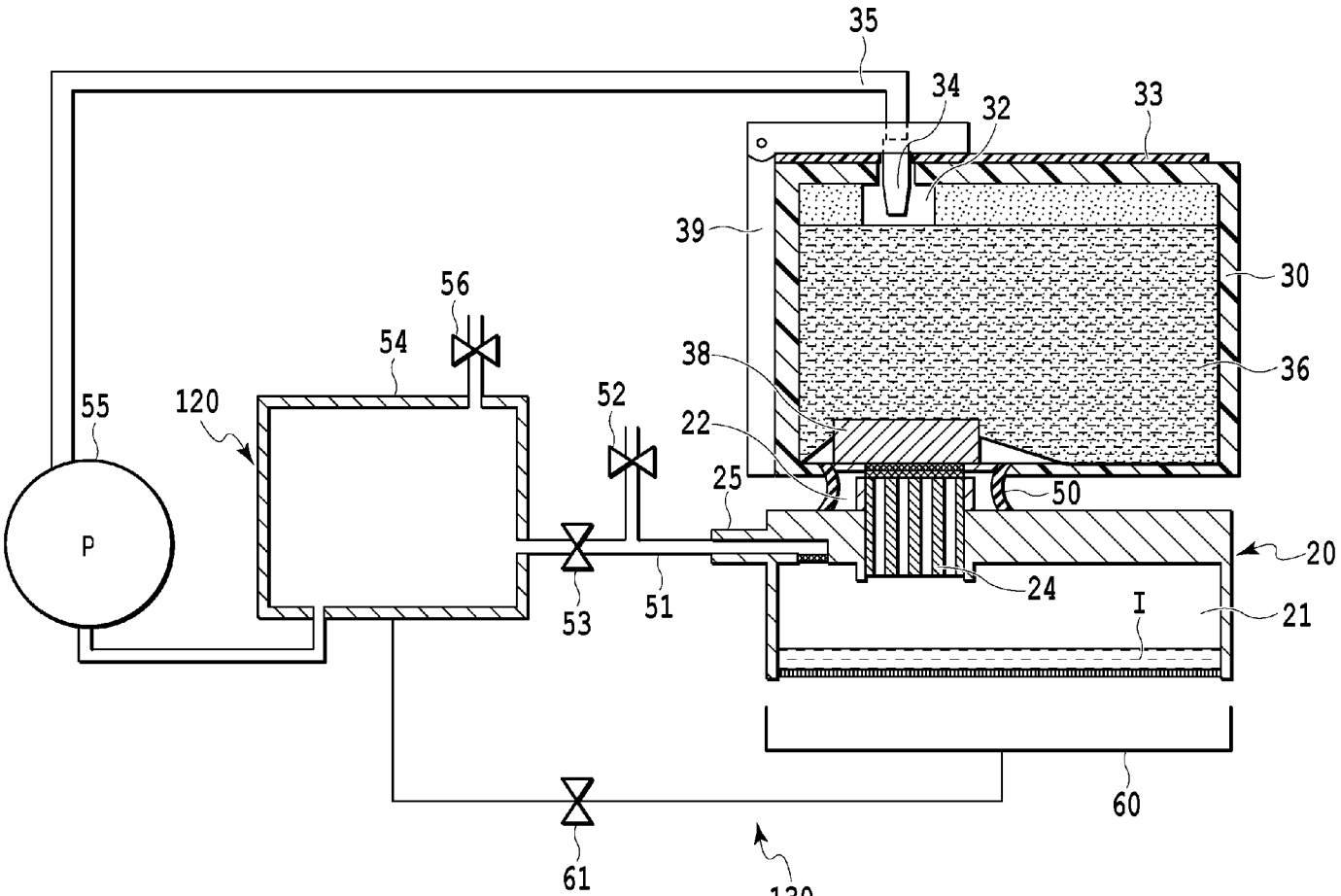
FIG. 2 is a diagram illustrating a schematic configuration of a supply system of ink in the printing apparatus in FIG. 1A.
Figure 3A:
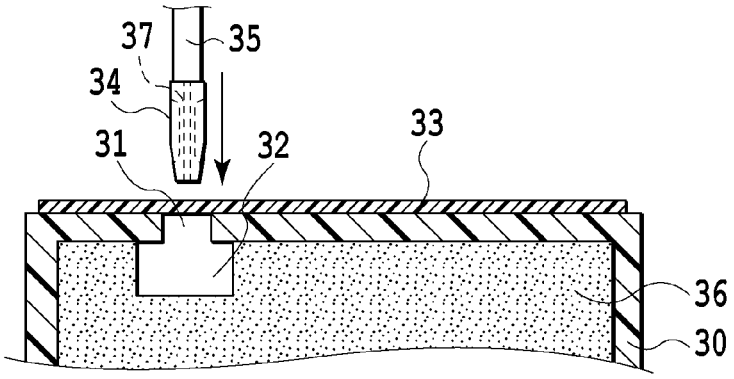
FIG. 3A is a cross section illustrating an ink tank before connection of the upper surface to the supply system of ink in FIG. 2.
Figure 3B:
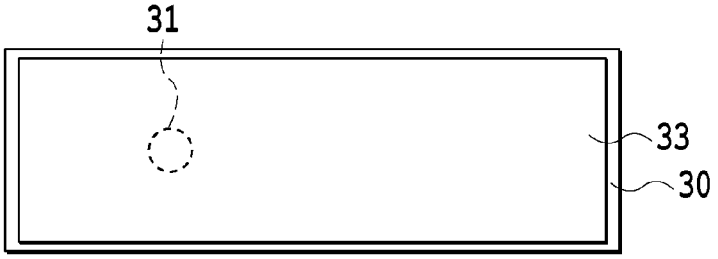
FIG. 3B is a plan view illustrating the ink tank before connection of the upper surface to the supply system of ink in FIG. 2.
Figure 3C:
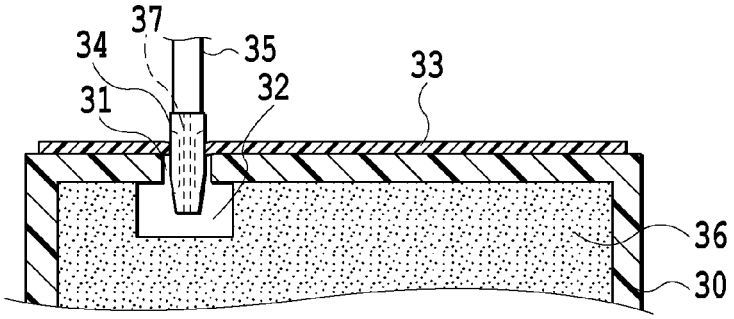
FIG. 3C is a cross section illustrating the ink tank after connection of the upper surface to the supply system of ink in FIG. 2.
Figure 3D:
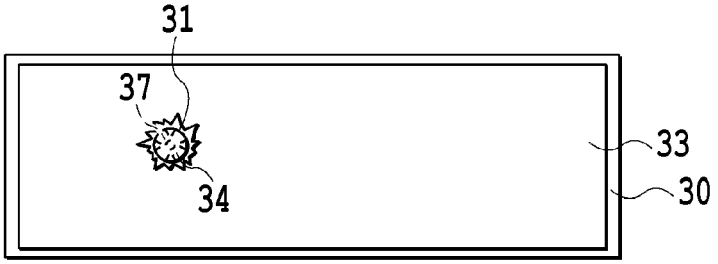
FIG. 3D is a plan view illustrating the ink tank after connection of the upper surface to the supply system of ink in FIG. 2.
Figure 4:
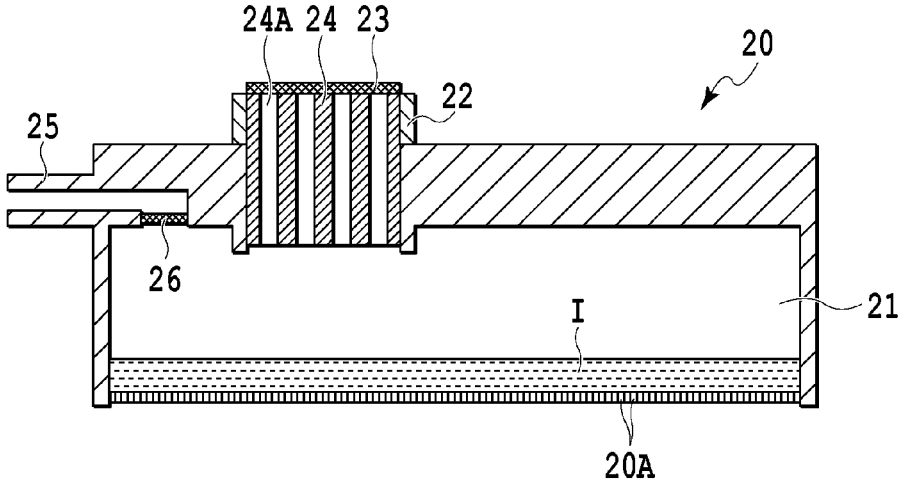
FIG. 4 is an enlarged diagram illustrating the print head in FIG. 2.

FIG. 2 is a diagram explaining the ink supply system 120 and the recovery processing system 130. FIG. 3A is a cross section illustrating an ink tank 30 (liquid accommodating container) before being connected to the ink supply system 120 in FIG. 2. FIG. 3B is a plan view illustrating the ink tank 30 before being connected to the ink supply system 120 in FIG. 2. FIG. 3C is across section illustrating the ink tank (liquid accommodating container) 30 at the time of being connected to the ink supply system 120 in FIG. 2. FIG. 3D is a plan view illustrating the ink tank 30 at the time of being connected to the ink supply system 120 in FIG. 2. FIG. 4 is an enlarged sectional view illustrating the print head 20 in FIG. 2.

The ink tank 30 is communicable with an outside through a pressure contact body provided therein and an air communicating opening 31 provided on an upper surface thereof. The ink tank 30 accommodates therein an absorbing element (liquid absorbing element) 36 made of a porous material, and the absorbing element is impregnated with ink. A negative pressure is generated in the ink tank 30 by a capillary force of the absorbing element 36. The ink tank 30 is fixed by a tank cover 39 attached on the printing apparatus body or the print head 20. As illustrated in FIG. 3A and FIG. 3B, a non-print ink accommodating chamber 32 and the air communicating opening 31 are provided on an upper part of the absorbing element 36 inside the ink tank 30. A seal label 33 on which color information of the ink tank 30 and the like are described is provided on an upper surface of the air communicated opening 31, and this seal label 33 prevents leakage of ink at the time of carrying the ink tank 30. At the time of fixing the ink tank 30 by the tank cover 39, a needle 34 provided in a tip of a non-print ink recirculating tube 35 smashes through the seal label 33 and enters into the non-print ink accommodating chamber 32, thereby establishing connection between the ink tank 30 and the non-print ink recirculating tube 35. At the time the needle 34 smashes through the seal label 33, a clearance formed between the needle 34 and the seal label 33 constitutes the air communicating opening 31. In addition, a V-groove 37 is formed on a side face of the needle 34 in the present embodiment, and in the present embodiment, the clearance between the needle 34 and the seal label 34, and the V-groove 37 act also as air communicating openings. The ink tank 30 is mounted on the upper part of the print head 20. In the present embodiment, the ink tank 30 is configured such that the air communicating opening 31 is provided on the upper surface of the ink tank 30 and the needle 34 is inserted therein, but the present invention is not limited thereto. The ink tank 30 may be configured such that the air communicating opening 31 is provided on an upper part of a side face of the ink tank 30, the non-print ink accommodating chamber 32 is formed to correspond thereto, and the needle 34 inserted from the air communicating opening 31 is led to the non-print ink accommodating chamber 32.

The print head 20 is provided with an unillustrated ejection energy generating element for ejecting ink I in an ink chamber 21 (a liquid in the liquid chamber) from ejection openings 20A. An electricity-heat conversion element (heater) or a piezo element may be used as the ejection energy generating element. In a case of using the electricity-heat conversion element, the heat generation releases bubbles from ink, and use of the bubble release energy allows ejection of the ink from the ejection opening 20A. Air (gases) together with ink I is present in the ink chamber 21. Therefore an ink accommodating part (liquid accommodating part) that accommodates ink I and an air accommodating part (gas accommodating part) that accommodates air (gases) are formed in the ink chamber 21.

Figure 5A:
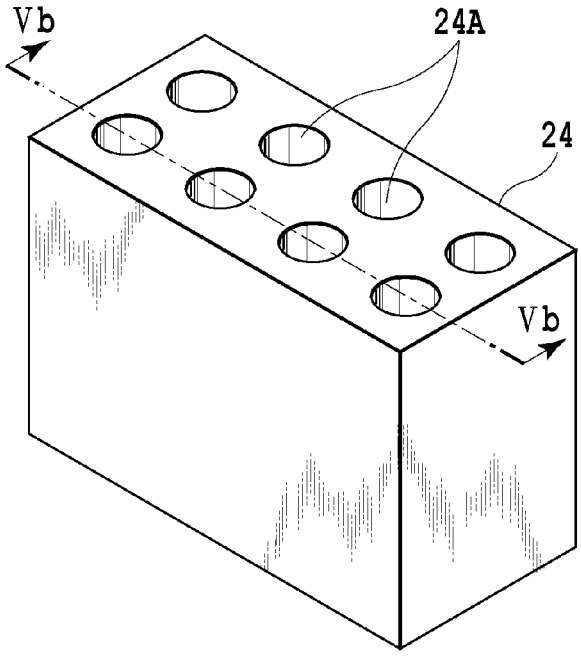
FIG. 5A is a perspective view illustrating an ink holding member.
Figure 5B:
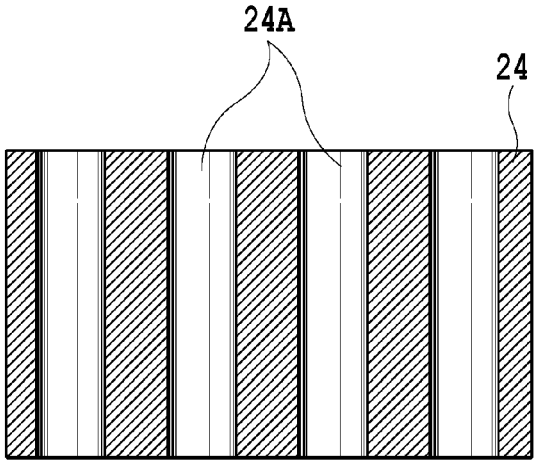
FIG. 5B is a cross section illustrating the ink holding member.

An ink supply part (supply opening) 22 is provided on an upper part of the ink chamber 21 to be communicated with the ink tank (liquid accommodating container) 30, and a filter member 23 is provided on an opening of the supply part 22. In the present embodiment, the filter member 23 is formed with mesh made of SUS. The mesh is woven with metallic fabrics, and an average width of the supply part 22 is approximately 10 mm. Providing the filter member 23 having fine sections prevents foreign particles from entering into the print head 20 from an outside. A lower surface of the filter member 23 comes in pressure contact with an ink holding member (liquid holding member) 24 that can hold ink. As illustrated in FIG. 5A and FIG. 5B, a plurality of flow passages 24A each having a circular section are formed inside the ink holding member 24. A diameter of each of the flow passages 24A is approximately 1.0 mm.

An opening 25 is provided on an upper part of the ink chamber 21 to be connected to a transfer part 51 that transfers gases and/or liquids as an external flow passage, and the opening 25 is provided with a filter 26. The opening 25 is configured such that a liquid (ink) or a gas in the ink chamber 21 can flow out into an outside. The opening 25 enables the liquid (ink) and the gas in the ink chamber 21 to flow out together. The opening 25 is configured such that a liquid (ink) or a gas outside of the print head 20 can flow therein. Further, the opening 25 may cause the liquid (ink) and the gas outside of the print head 20 to flow therein.

The print head 20 and the ink tank 30 are connected as illustrated in FIG. 2. That is, the filter member 23 on the print head 20-side and the pressure contact body 38 on the ink tank 30-side are connected to come in pressure contact with each other in an upper-lower direction. A connecting part between the print head 20 and the ink tank 30 is configured to surround the circumference with a rubber elastic cap member 50, thus keeping sealing properties of the connecting part. In the present embodiment, since the print head 20 and the ink tank 30 are directly connected, the ink supply passage (liquid supply passage) therebetween is extremely short.

The transfer part 51 connected to the opening 25 of the print head 20 is bifurcated, wherein one is communicated with the outside air through an openable valve 52, and the other is communicated with a buffer chamber 54 through an openable valve 53. The buffer chamber 54 is provided with a space formed therein with a volume of approximately 10 mL, and is connected to the non-print ink recirculating tube 35 through a pump 55. The non-print ink recirculating tube 35 is connected to the ink tank 30 through the needle 34 pricked in the air communicating opening 31 of the ink tank 30. The pump 55 is a transfer part as means that transfers liquids (ink) and/or gases (air), such as causing a liquid (ink) and/or a gas (air) to flow into the print head 20 or causing a liquid (ink) and/or a gas (air) to flow out of the print head 20. In a case of the present embodiment, a forward reverse rotatable tube pump is used as the pump 55.

A cap 60 is connected to the buffer chamber 54 through an openable valve 61. The cap 60 is attached firmly to a formation face (ejection opening formation face) of the ejection opening 20A in the print head 20. In a state where the cap 60 is attached firmly to the ejection opening formation face to cap the ejection opening 20A, ink can be sucked/discharged into the cap 60 from the ejection opening 20A by sucking the inside of the cap 60 by the pump 55 (suction recovery operation). In addition, there can be performed a preliminary ejection operation of ejecting ink not used for printing an image into the cap 60 from the ejection opening 20A and a pressurizing recovery operation of pressurizing ink in the print head 20 to be forcibly discharged into the cap 60 from the ejection opening 20A. In the pressurizing recovery operation, the pressurizing force generated by the pump 55 can act on the inside of the print head 20 through the buffer chamber 54 and the valve 53. The ink received in the cap 60 by this recovery process can be returned back to the absorbing element 36 in the ink tank 30 from the air communicating opening 31 through the non-print ink recirculating tube 35 by the suction force generated by the pump 55.

Next, an explanation will be made of states of the printing apparatus at the static time of ink, the print operation time, the cleaning time of the print head, the supply start time of ink and the recirculation time of non-print ink separately.

Figure 6A:
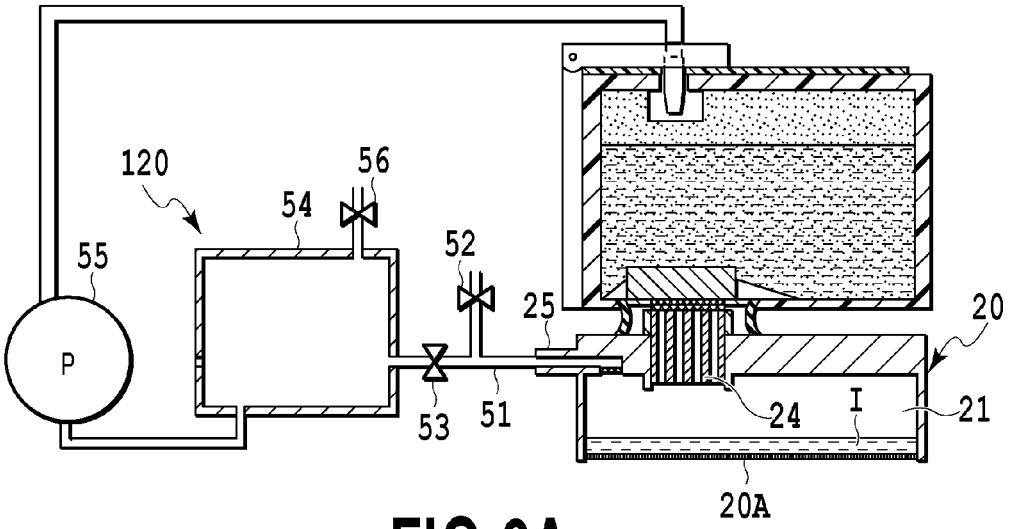
FIG. 6A is a diagram explaining a state of the supply system of ink at the static time of ink.
Figure 6B:
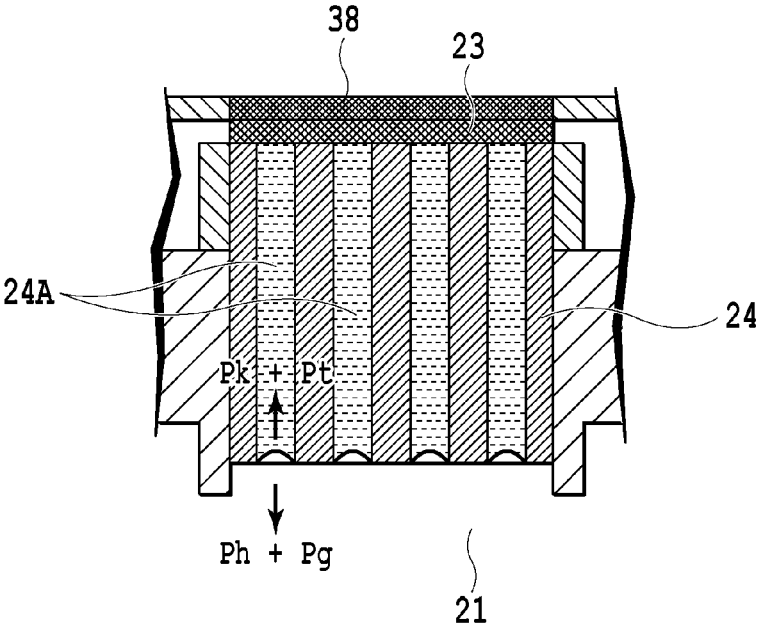
FIG. 6B is a diagram illustrating the ink holding member.

(At the static time of ink) At the static time of ink in the stopping time or the like of the printing apparatus, the valves 52, 53 are closed as illustrated in FIG. 6A. The flow passages 24A of the ink holding member 24 are filled with ink. The ink chamber 21 in the print head 20 is kept in a predetermined negative pressure state to maintain meniscus of the ink formed in the ejection chamber 20A. The meniscus of the ink is formed in the flow passage 24A of the ink holding member 24 as illustrated in FIG. 6B, and forces Pt, Ph, Pk, and Pg act on the meniscus. The force Pt is a force of pulling in the meniscus to the ink tank side by the negative pressure in the ink tank 30, the force Ph is a force of pulling in the meniscus into the print head 20 by the negative pressure in the print head 20, the force Pk is a meniscus force of pulling in the ink to the ink tank side by surface tension of ink, and the force Pg is a force by which the ink moves downward by the self-weight of the ink. Balance of these forces enables the meniscus formed in the ink holding member 24 to be maintained and hold the static state of the ink in the print head 20.

Figure 7A:
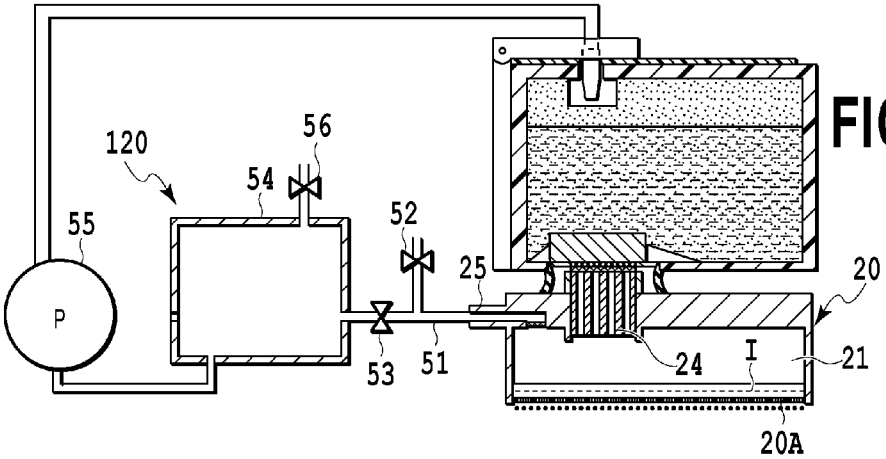
FIG. 7A is a diagram explaining a state of the supply system of ink at the printing.
Figure 7B:
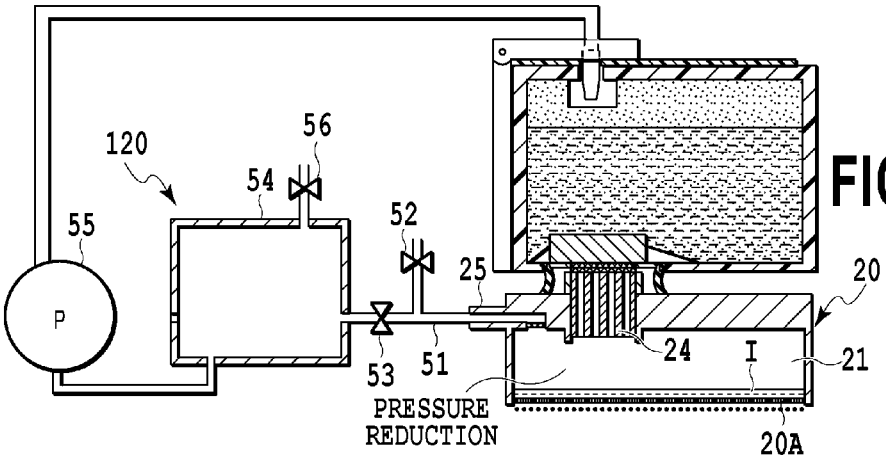
FIG. 7B is a diagram explaining a state of the supply system of ink at the printing.
Figure 7C:
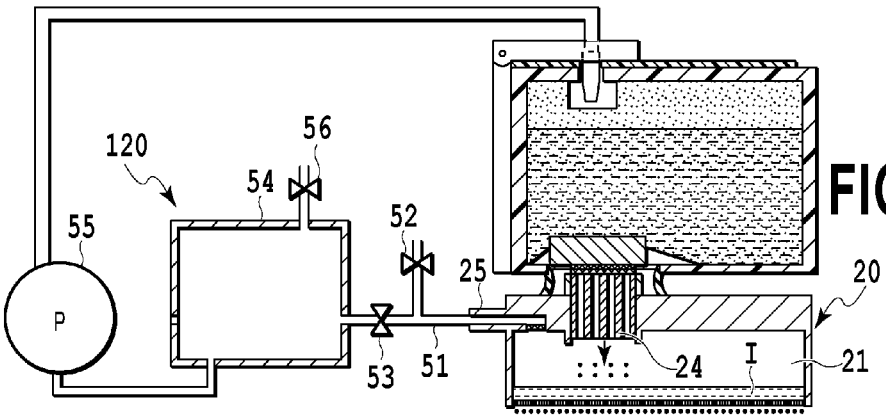
FIG. 7C is a diagram explaining a state of the supply system of ink at the printing.

(At the print operation time) At the print operation time of the printing apparatus, the valves 52, 53 are closed as illustrated in FIG. 7A. When ink is ejected from the ejection opening 20A as illustrated in FIG. 7A, ink I in the ink chamber 21 is consumed to further reduce the pressure in the ink chamber 21 as illustrated in FIG. 7B. This increasing negative pressure in the ink chamber 21 acts as a force in the direction of pulling the ink in the flow passage 24A of the ink holding member 24 into the ink chamber 21. When the negative pressure in the ink chamber 21 increases to a predetermined value or more, the meniscus of the ink formed in the flow passage 24A of the ink holding member 24 is broken, the ink in the ink tank 30 is supplied to the print head 20 as illustrated in FIG. 7C. In addition, the negative pressure in the ink chamber 21 is reduced by this supply of the ink, and thereby the meniscus is again formed in the flow passage 24A of the ink holding member 24 as illustrated in FIG. 7A to stop the supply of the ink. Thus the ink is supplied into the ink chamber 21 of the print head 20 according to the consumption amount of the ink.

The meniscus force Pk of the meniscus formed in the flow passage 24A of the ink holding member 24 acts against the flow of the ink supplied to the print head 20 from the ink tank 30. Therefore when the meniscus force Pk is too large, it is hard to supply the ink to the print head 20 to degrade supply performance of the ink. The meniscus force P of the meniscus of a liquid formed in the opening of the liquid flow passage can be expressed according to the following formula 1 when surface tension of the liquid is indicated at γ, a radius of the opening is indicated at r, and a contact angle of the ink in the liquid flow passage is indicated at θ.

$$P = \frac{2\gamma\cos\theta}{r} \quad \text{(Formula 1)}$$

When the opening of the flow passage is not circular, the meniscus force P of the opening has a relation of the following formula 2 to a circumferential length L and an opening area S (meniscus force P is in proportion to L/S). Even if the opening is not formed in a true circle, when the opening is converted into a circular tube of a radius r having the same area as the opening, the theoretical formula of the formula 1 can be applied regardless of the shape of the opening.

$$P \propto L/S \quad \text{(Formula 2)}$$

Accordingly, as the radius r of the opening of the liquid flow passage is larger, the meniscus force P becomes smaller. A plurality of the flow passages 24A, each inner diameter of which is approximately 1 mm, are formed to penetrate through the ink holding member 24 in the present embodiment. The inner diameter of the flow passage 24A is set such that the meniscus force of the ink in the flow passage 24A is smaller than the meniscus force of each of the filter member 23 and the pressure contact body 38. At the supply time of the ink following the print operation, since the meniscus of the ink is not formed in each of the filter member 23 and the pressure contact body 38, the supply performance of the ink can be enhanced to realize the high-speed printing.

If the ink holding member 24 is not provided, the meniscus is formed in the filter member 23 or the pressure contact body 38 to degrade the supply performance of the ink. Specifically, since an inner diameter of the flow passage of the ink formed in the filter member 23 is approximately one thousandth of an inner diameter of the flow passage 24A of the ink holding member 24, the meniscus force in the former flow passage of the ink is approximately 1000 times the meniscus force in the latter flow passaged 24A. Therefore in a case where the ink holding member 24 is not provided, the supply performance of the ink is largely degraded.

(At the cleaning time of the print head) At the time of wiping the ejection opening formation face of the print head 20 for cleaning, the inside of the print head 20 is pressurized to push out ink I in the ink chamber 21 outside out of the ejection opening 20A to improve lubricating properties of the ejection opening formation face.

Figure 8A:
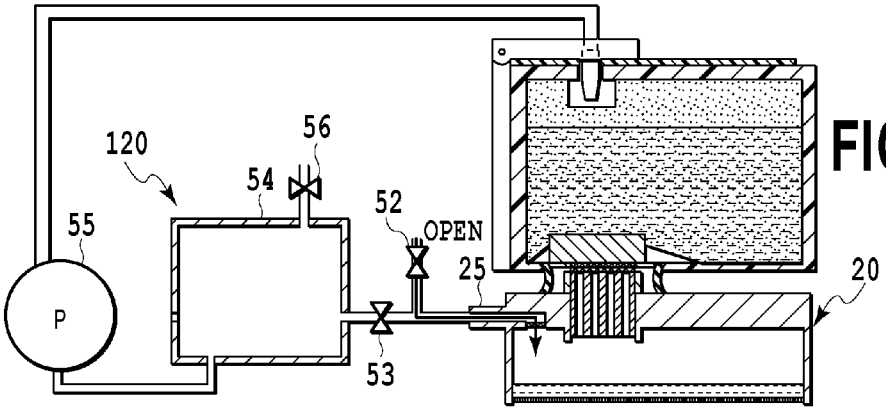
FIG. 8A is a diagram explaining a state of the supply system of ink at the time of introducing outside air in the head.
Figure 8B:
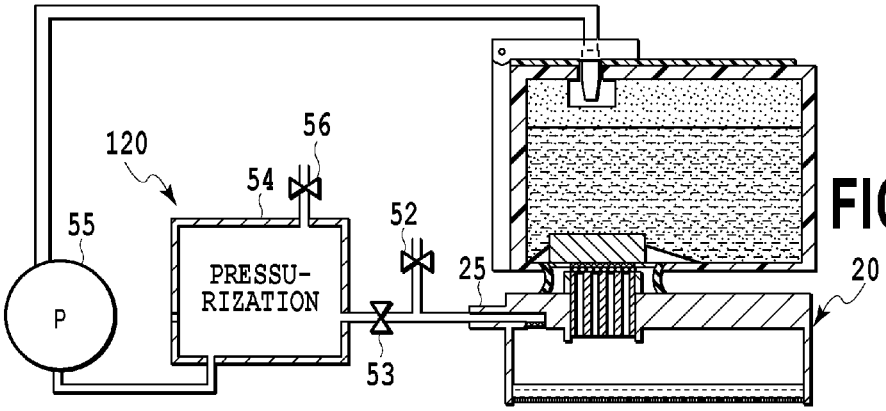
FIG. 8B is a diagram explaining a state of the supply system of ink at the time of pressurizing the inside of a buffer.
Figure 8C:
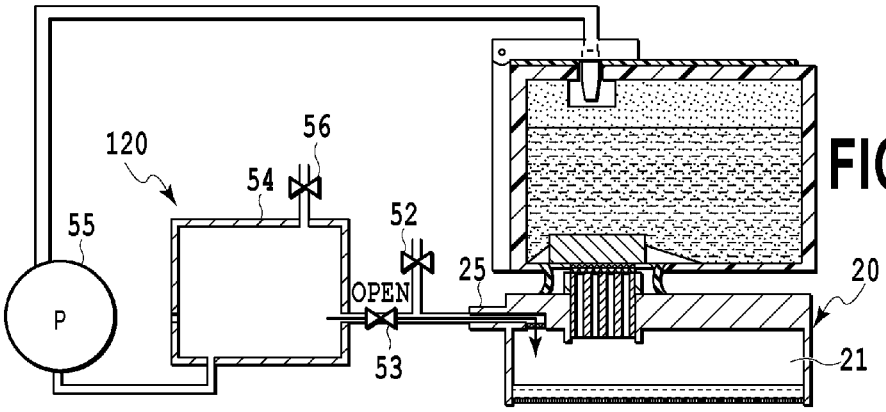
FIG. 8C is a diagram explaining a state of the supply system of ink at the time the air in the buffer flows into the print head.

First, opening the valve 52 as illustrated in FIG. 8A causes outside air to flow into the print head 20, thus eliminating the negative pressure in the ink chamber 21. Next, as illustrated in FIG. 8B, the pump 55 is rotated in one direction in a state where the valves 52, 53 and 56 are closed to deliver air into the buffer chamber 54, thus pressurizing the inside of the buffer chamber 54. Next, opening the valve 53 as illustrated in FIG. 8C causes the pressurized air in the buffer chamber 54 to flow into the print head 20, thus pressurizing the inside of the ink chamber 21. At this time, in a case where the liquid (ink) is mixed in the buffer chamber 54 or the transfer part 51 or the like, the liquid (ink) and/or the gas (air) flows into the print head 20.

Figure 9A:
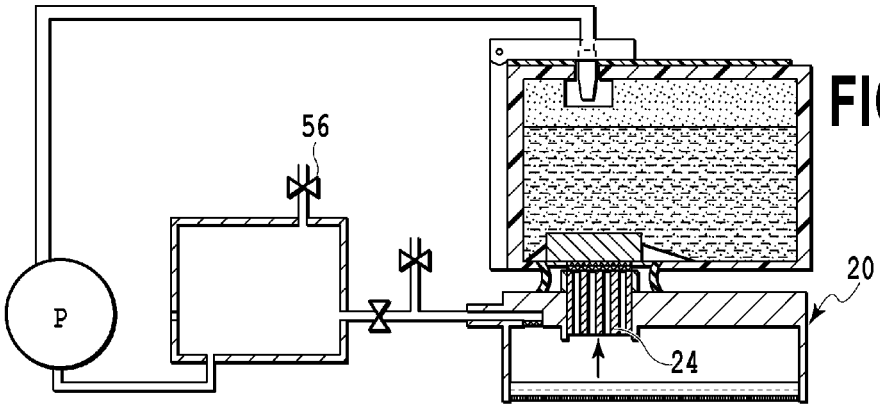
FIG. 9A is a diagram explaining a state of the supply system of ink at the time of pressurizing the inside of an ink chamber at the cleaning.
Figure 9B:
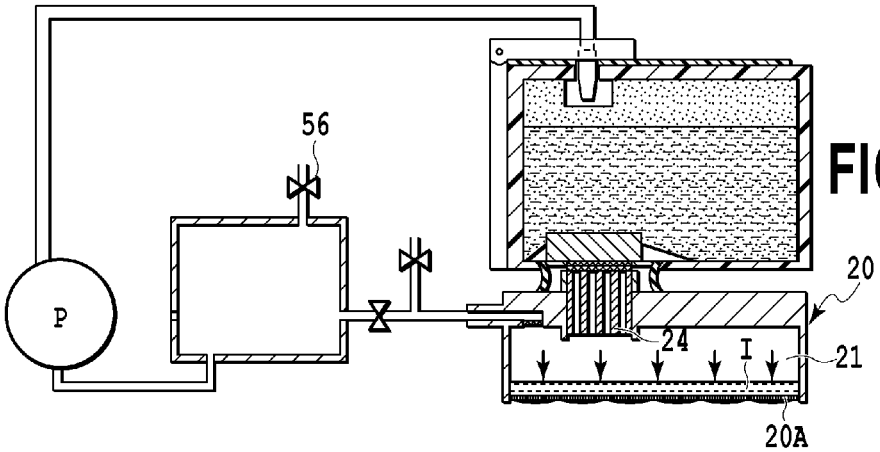
FIG. 9B is a diagram explaining a state of the supply system of ink at the time of pressurizing the inside of the ink chamber at the cleaning.

By thus pressurizing the inside of the ink chamber 21, the ink in the flow passage 24A of the ink holding member 24 and the ink in the ink chamber 21 move as illustrated in FIG. 9A and FIG. 9B.

Figure 10A:
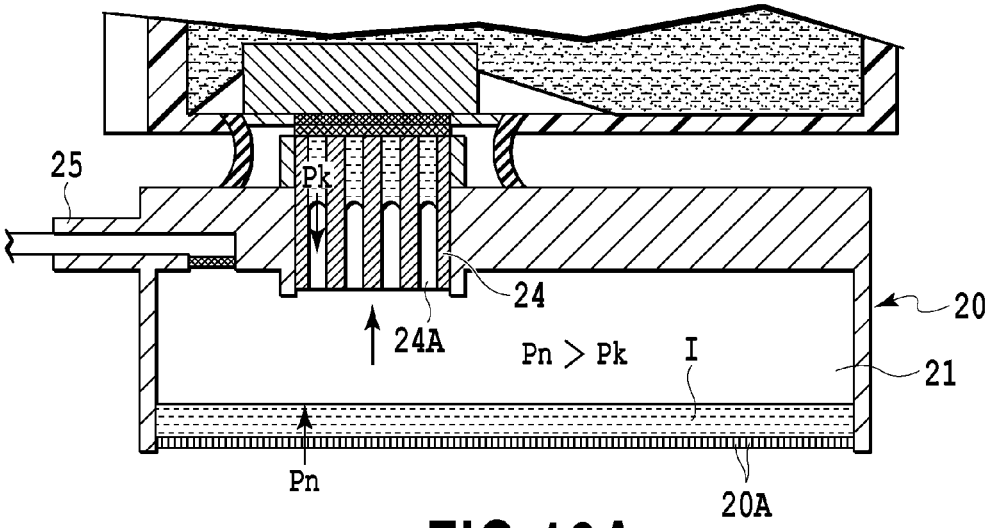
FIG. 10A is a diagram explaining a state of the supply system of ink at the cleaning of the print head after pressurizing the inside of the ink chamber.
Figure 10B:
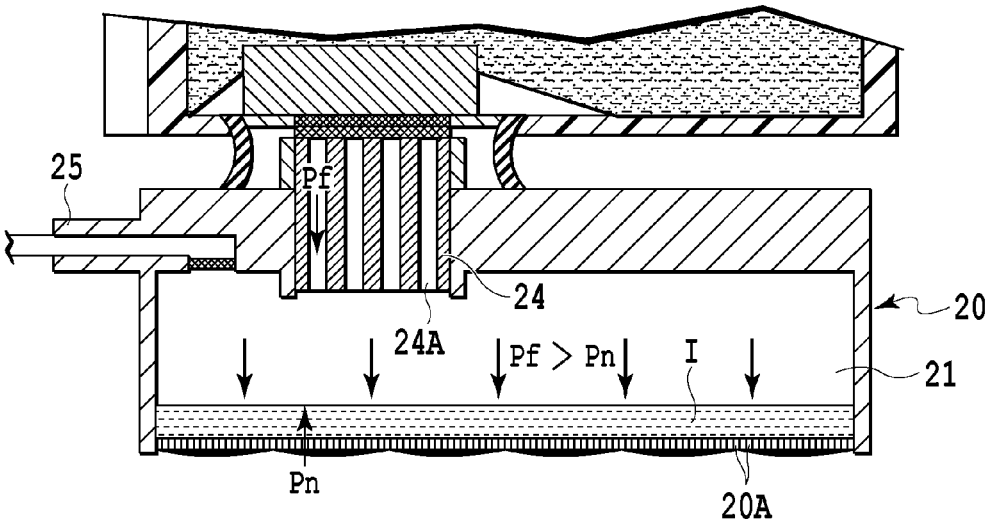
FIG. 10B is a diagram explaining a state of the supply system of ink at the cleaning of the print head after pressurizing the inside of the ink chamber.

An inner diameter Df of the flow passage of the ink formed in the filter member 23 in the print head side, an inner diameter Dk of the flow passage 24A of the ink holding member 24, and an inner diameter Dn of the ejection opening 20A are set as the following relation. Df<Dn<Dk Therefore the meniscus force Pf in the filter member 23 in the print head side, the meniscus force Pk of the flow passage 24A of the ink holding member 24 and the meniscus force Pn of the ejection opening 20A have the following relation. Pf>Pn>Pk In a case where the inside of the ink chamber 21 is pressurized, as illustrated in FIG. 9A the meniscus in the flow passage 24A of the ink holding member 24 goes back upward in the figure, and after the meniscus reaches the filter member 23, as illustrated in FIG. 9B the ink is pushed out of the ejection opening 20A. More specifically, the meniscus of the ink holding member 24 having the small meniscus force Pk first goes back as illustrated in FIG. 10A, and the ink in the flow passage 24A flows back. As illustrated in FIG. 10B, the ink in the flow passage 24A is all returned back into the ink tank 30, and thereby the meniscus is formed in the filter member 23. Since the meniscus force Pn of the ejection opening 20A is smaller than the meniscus force Pf of the filter member 23, the ink in the ink chamber 21 is pushed out of the ejection opening 20A as illustrated in FIG. 10B.

The ink chamber 21 is pressurized to the pressure Pc. When the pressure Pc exceeds the meniscus force Pk, the meniscus of the ink holding member 24 is moved to the ink tank 30-side and the ink is pushed out of the ejection opening 20A without moving the meniscus in the filter member 23 having the meniscus force Pf. Therefore the ink can be pushed out of the ejection opening 20A without moving the meniscus in the filter member 23, that is, without pushing the air in the print head 20 into the ink tank 30.

Figure 9C:
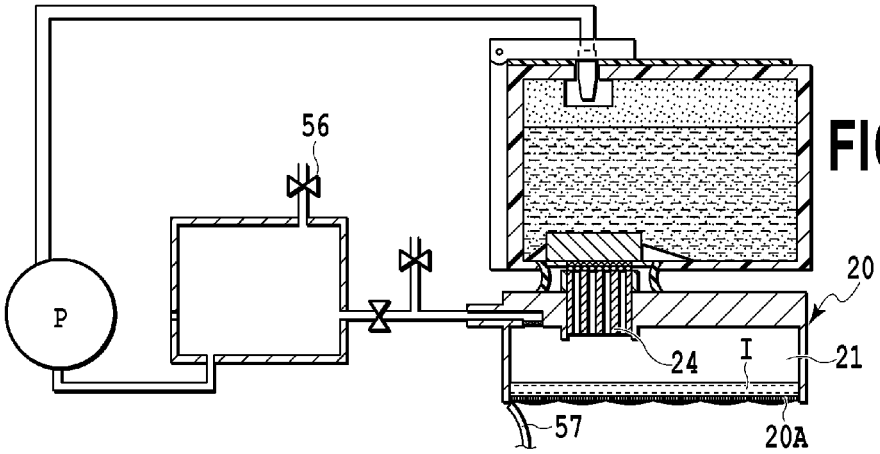
FIG. 9C is a diagram explaining a state of the supply system of ink at the time of pressurizing the inside of the ink chamber at the cleaning.

After the ejection opening formation face is sufficiently wet with the ink thus pushed out of the ejection opening 20A or while pushing the ink out of the ejection opening 20A, the ejection opening formation face is wiped by a plate-shaped cleaning member 57 as illustrated in FIG. 9C. As a result, it is possible to enhance the cleaning capability of the ejection opening formation face. The cleaning member 57 is made of, for example, urethane rubber, and moves in a right-left direction in FIG. 9C keeping contact with the ejection opening formation face. This movement can be performed accompanied by the movement of at least one of the cleaning member 57 and the print head 20.

After the wiping operation by the cleaning member 57, the pump 55 is rotated in a direction of causing the liquid (ink) and/or the gas (air) to flow out outside of the print head 20 to introduce a negative pressure into the print head 20, thus making it possible to return the supply system of the ink back to the state as illustrated in FIG. 6A.

(At the supply start time of ink) When the ink tank 30 is connected to the print head 20 where the ink is not present, the cap 20 is set in a capping state of being firmly attached to the ejection opening formation face of the print head 20, and thereafter, the inner part of the cap 60 is sucked by the pump 55. As a result, as illustrated in FIG. 6A the ink in the ink tank 30 can be supplied to the print head 20. In addition, a negative pressure is generated by the pump 55, and the generated negative pressure is caused to act into the ink chamber 21 through the buffer chamber 54, the valve 53 and the opening 25, thus making it possible to supply the ink in the ink tank 30 to the print head 20 as well. In a case where the former cap 60 is used for suction, the ink that is not used in printing an image is discharged into the cap 60 as similar to the suction recovery operation time. On the other hand, for suction to the inside of the ink chamber 21 through the opening 25 as the latter, the consumption of the ink can be suppressed by supplying the ink into the print head 20 without discharging the ink that is not used in printing. The meniscus of the ink in the ejection opening 20A can be formed by the suction recovery operation of sucking the inner part of the cap 60 in the capping state.

A supply amount of ink that is supplied into the ink chamber 21 of the print head 20 can be adjusted to an optimal amount by using an unillustrated ink amount sensor (liquid surface sensor of ink or the like) that detects an ink amount in the ink chamber 21. The meniscus of the ink in the ejection opening 20A can be formed by the suction recovery operation of sucking the inner part of the cap 60 in the capping state.

After a remaining ink amount in the ink tank 30 connected to the print head 20 disappears to reduce the ink amount in the print head 20, in a case where a new ink tank 30 is connected to the print head 20, it is necessary to increase the ink amount in the print head 20 to an optimal amount. In this case, the negative pressure generated by the pump 55 is introduced from the opening 25, making it possible to supply ink in the newly connected ink tank 30 into the print head 20. In addition, when the ink amount in the print head 20 is reduced to the extent that it is not able to be detected by the ink amount sensor, introduction of the negative pressure into the print head 20 through the opening 25 enables the ink in the ink tank 30 to be supplied into the print head 20.

By thus introducing the negative pressure (suction force for reducing pressure in the print head 20) into the print head 20 through the opening 25, the ink can be supplied into the print head 20 without consuming the ink wastefully. At such a supply time of the ink, the cap 60 may be set to the capping state.

(At the non-print ink recirculating time) Hereinafter, an explanation will be made of the characteristic configuration of the present invention.

FIG. 11A to FIG. 11D are diagrams each explaining a state of a supply system of ink at the non-print ink recirculating time. It should be noted that non-print ink (second liquid) herein is ink that is reserved in the cap 60 in the recovery process and is not used in printing, and is ink (out of a supply target) that is not again supplied to the print head 20 even if it is returned back to the ink tank 30 by recirculation. In addition, the ink as the non-print ink is the amount equal to or less than 10% of a filling amount of ink that is unused in the ink tank 30 initially.

Figure 11C:
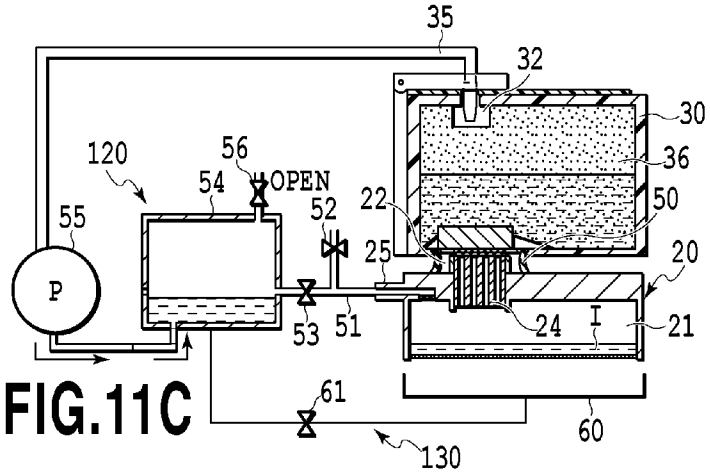
FIG. 11C is a diagram explaining a state of the supply system of ink at the non-print ink recirculating time.
Figure 11A:
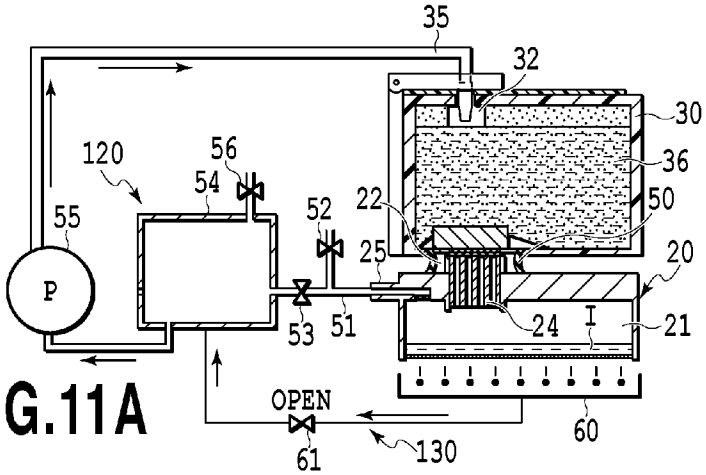
FIG. 11A is a diagram explaining a state of the supply system of ink at the non-print ink recirculating time.

As illustrated in FIG. 11A, the ink discharged from the print head 20 by a preliminary ejection or suction recovery process is received in the cap 60. At this time, in a state where the valve 61 is opened, a suction force of the pump 55 is used to transfer the ink in the cap 60. As illustrated in FIG. 11B, at a point when the non-print ink is sucked by a predetermined amount, as illustrated in FIG. 11C the valve 61 is closed, the valve 56 is opened and the pump 55 is operated in a direction of sending out the non-print ink to the buffer chamber 54, thus reserving the non-print ink in the buffer chamber 54. This is because when the ink tank 30 is new and the absorbing element 36 is filled with unused ink (printing ink or first liquid), in a case where the non-print ink is returned to the ink tank 30, the non-print ink and the unused ink are possibly mixed. Therefore the non-print ink is once reserved in the buffer chamber 54 to a point when the unused ink in the ink tank 30 is reduced by a predetermined amount. It should be noted that in a case where a predetermined amount of ink is consumed after replacement of the ink tank 30 and the unused ink in the ink tank 30 is reduced by the predetermined amount, the ink may be recirculated to the ink tank 30 from the cap 60.

Figure 11D:
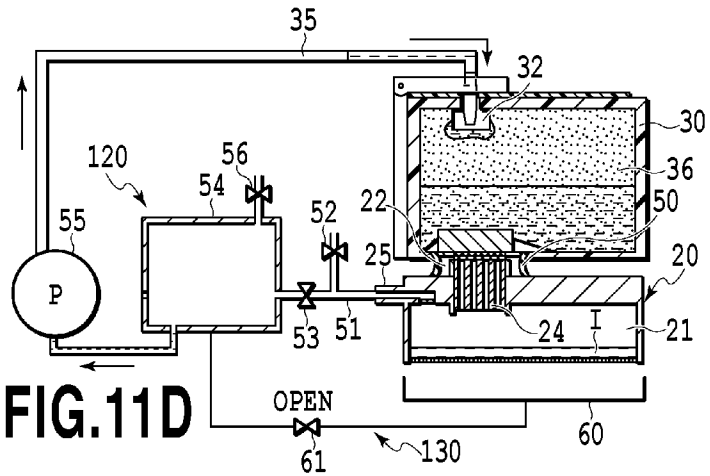
FIG. 11D is a diagram explaining a state of the supply system of ink at the non-print ink recirculating time.
Figure 11B:
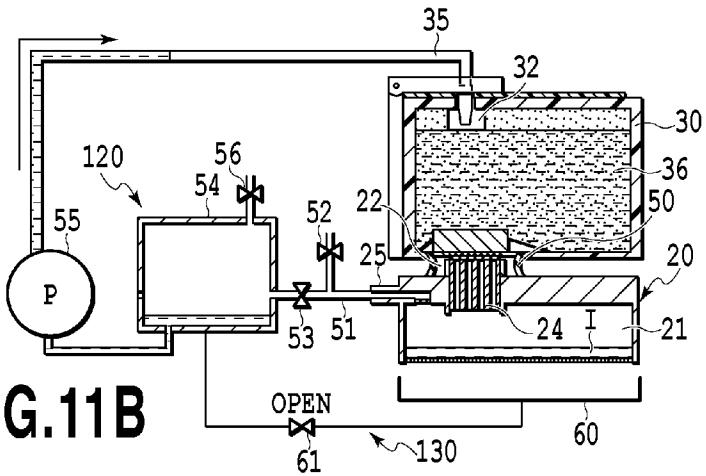
FIG. 11B is a diagram explaining a state of the supply system of ink at the non-print ink recirculating time.

As illustrated in FIG. 11C, the non-print ink reserved in the buffer chamber 54 is discharged to the non-print ink accommodating chamber 32 in the ink tank 30 by a suction force of the pump 55 by opening the valve 61 and closing the valve 56 as illustrated in FIG. 11D after the recovery process. At this time, the absorbing element 36 forming a bottom part of the non-print ink accommodating chamber 32 is a portion already filled with unused ink once, and thereafter, is a portion (part) recovered to become capable of again absorbing the ink caused by the lowering of a liquid surface following consumption of the unused ink. Therefore the absorbing element 36 is in a state of being wet with ink (ink and air are mixed). Therefore the non-print ink discharged to the non-print ink accommodating chamber 32 is easily sucked into the absorbing element 36 from the bottom part of the non-print ink accommodating chamber 32. The side part of the non-print ink accommodating chamber 32 is not in a state of being wet with the ink, but the non-print ink is slightly absorbed in the absorbing element 36 from the side part as well.

Figure 12:
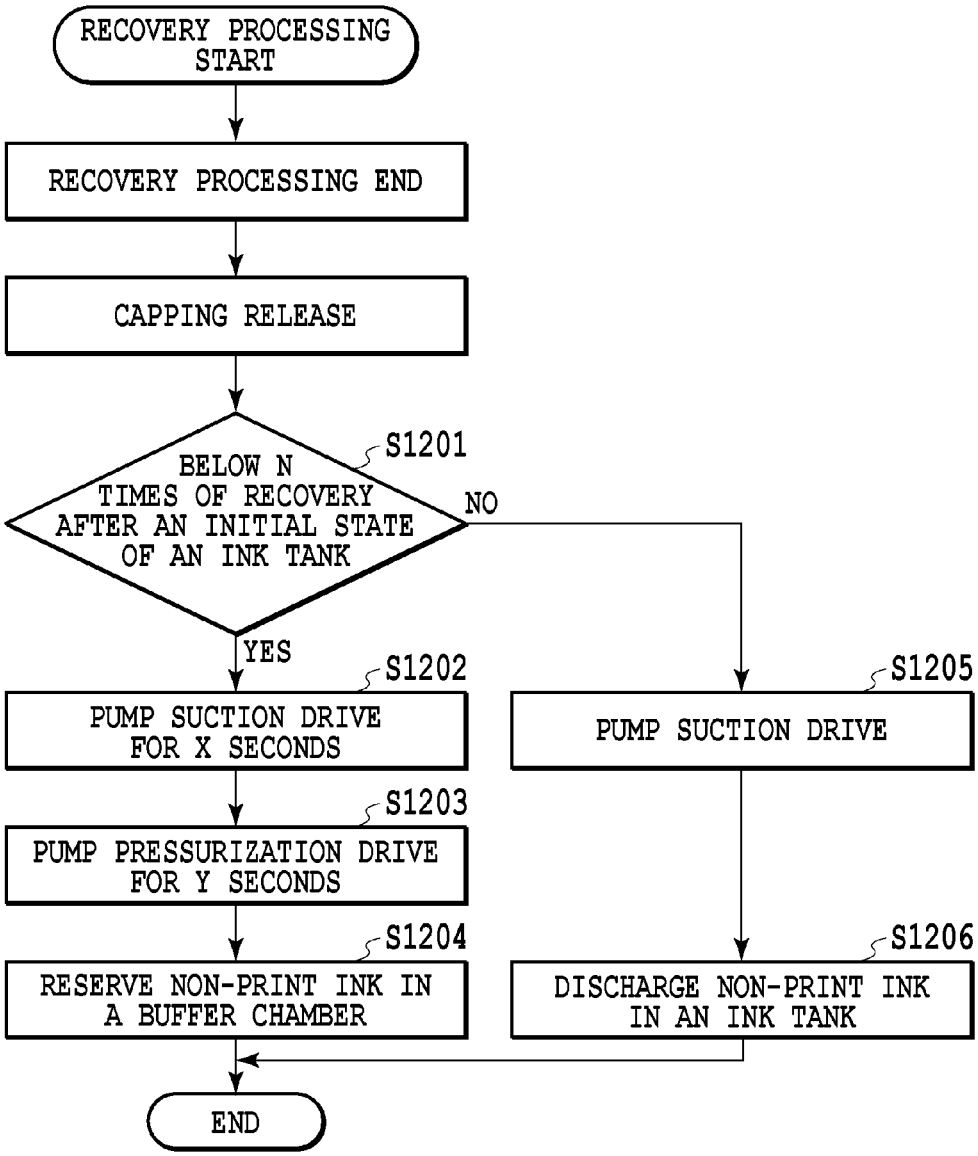
FIG. 12 is a flow chart illustrating a non-print ink recirculating system.

FIG. 12 is a flow chart illustrating the process at the time of recirculating the non-print ink. Hereinafter, an explanation will be made of the recovery process with the recirculation operation in the present embodiment along this flow chart. After the recovery process is started and the recovery processes of preliminary ejection, pressurization and suction are executed, the capping state is released. Thereafter, at step S1201 it is determined whether or not the number of times by which the recovery process has been executed from a use start of the ink tank is equal to or less than a predetermined number of times (N times). This predetermined number N of times is a value for determining the ink amount consumed from the ink tank 30, and can preliminarily be varied according to the ink amount consumed for recovery. Since the ink in the ink tank 30 is still not consumed by the predetermined amount in a case where the number of times by which the recovery process has been executed at step S1201 is equal to or less than N times, the process goes to step S1202, wherein the valve 61 is opened, the valve 56 is closed, and a suction operation by the pump 55 is performed for X seconds. After that, at step S1203 the valve 61 is closed, the valve 56 is opened, and a pressurizing operation by the pump 55 is performed for Y seconds. This operation allows the non-print ink to be reserved in the buffer chamber 54 at step S1204 (refer to FIG. 11C). It should be noted that X seconds for performing the suction operation are set to the time sufficient for causing the non-print ink to reach the buffer chamber 54, and the time in which the non-print ink does not reach the ink tank 30 from the buffer chamber 54. Y seconds for performing the pressurizing operation are set to the time in which all the non-print ink in the non-print ink recirculating tube 35 between the pump 55 and the ink tank 30 reaches the buffer chamber 54.

In a case where at step S1201 it is determined that the number of times by which the recovery process has been executed is larger than N times (a predetermined number of times), it is determined that the ink in the ink tank 30 is sufficiently consumed and the recirculation of the ink is possible, and the process goes to step S1205, wherein the suction operation of the pump 55 is performed. Then at step S1206 the non-print ink reserved in the buffer chamber 54 is discharged to the non-print ink accommodating chamber 32 in the ink tank 30. The process at the time of recirculating the non-print ink through these processes is completed.

Figure 13:
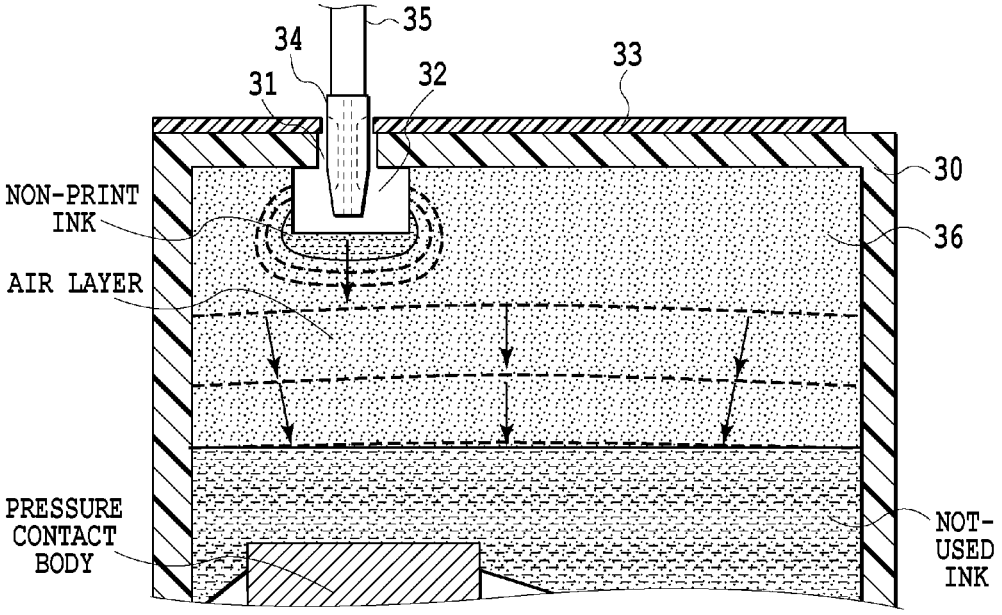
FIG. 13 is a cross section illustrating the ink tank at the non-print ink recirculating time.

FIG. 13 is a cross section illustrating the ink tank at the time of recirculating the non-print ink. The non-print ink with which the absorbing element 36 in the ink tank 30 (in the liquid accommodating container) has been impregnated is supplied to the print head 20 by the print operation or the suction operation to flow down to a lower part of the absorbing element 36 (lower the ink liquid surface). At this time air is introduced into the non-print ink accommodating chamber 32 through the clearance between the needle 34 smashed (inserted) through the upper surface of the ink tank 30 and the air communicating opening 31 by the amount corresponding to the extent that the ink is supplied to the print head 20. Therefore an air layer is formed on the unused ink. The recirculated non-print ink is discharged into the non-print ink accommodating chamber 32 for accumulation. The accumulated non-print ink spreads out to the lower part in the absorbing element 36 (from the bottom part and side part of the non-print ink accommodating chamber 32) by a capillary force and a self-weight of the absorbing element 36. However, the amount of the non-print ink is equal to or less than 10% of a filling amount of the unused ink initially presents in the ink tank 30, and even if the non-print ink spreads out, the non-print ink is held by the capillary force of the absorbing element 36. Therefore since the air layer regularly exists between the unused ink and the non-print ink to separate the non-print ink from the unused ink, the non-print ink and the unused ink do not mix with each other. In addition, since the amount of the non-print ink is equal to or less than 10% of a filling amount of the unused ink initially present in the ink tank 30, the ink tank 30 has a sufficient volume for accommodating the non-print ink, and therefore the non-print ink does not overflow from the ink tank 30. Accordingly there is no possibility that the inside of the apparatus and users do not get dirty with the non-print ink. When the unused ink in the ink tank 30 disappears, the ink tank 30 is to be removed from the apparatus to be replaced by a new ink tank. On this occasion, the seal label 33 is in a state of being already broken with the hole formed, but since the non-print ink is absorbed in the absorbing element 36 to be held therein, it does not leak from the hole. In addition, since the non-print ink and the unused ink are accommodated in the same absorbing element, it is not necessary to provide another absorbing element for accommodating the non-print ink to cut down on the number of components.

In this way, by discharging and reserving the non-print ink in a portion in the ink tank where the unused ink for printing has been reserved for replacement of the unused ink, it is possible to miniaturize the apparatus without the mixing of the unused ink and the non-print ink.

It should be noted that in the present embodiment, the explanation is made of the configuration that the needle 34 is inserted in the air communicating opening 31 to perform the recirculation of the non-print ink, but the present invention is not limited thereto. That is, an introduction opening may be provided to be separated from the air communicating opening, and the non-print ink may be recirculated by inserting a needle in the introduction opening. In this case, it is necessary to dispose the non-print ink accommodating chamber 32 in a position for the needle to be led by the introduction opening. Further, in this case, the non-print ink recirculating tube 35 and the ink tank 30 may be connected by a joint or the like without using the needle.

In the present embodiment, the explanation is made of the configuration that the non-print ink is the ink that is initially accommodated as the unused ink in the ink tank 30 and is again returned back to the ink tank 30. However, the present invention is not limited thereto, but ink (ink of another color) that is initially accommodated in another ink tank may become non-print ink, which will be returned back to the ink tank 30.

In this case, the pump 55 is connected to ink tanks of a plurality of colors through valves, and the ink recirculation can be realized by performing the opening/closing of the valve and the pressurizing and/or suction operations of the pump 55 as needed.

In addition, the non-print ink mixed in the buffer chamber 54 may be returned back to the ink tank 30. In this case, a plurality of caps are connected to the buffer chamber 54 through valves, and the ink recirculation can be realized by performing the opening/closing of the valve and the pressurizing and/or suction operations of the pump 55 as needed.

In addition, the non-print ink may include ink ejected outside of the print medium at the time of performing a print with no margin. In this case, means that leads the ink ejected outside of the print medium is connected to the buffer chamber 54 through a valve, and the ink recirculation can be realized by performing the opening/closing of the valve and the pressurizing and/or suction operations of the pump 55 as needed.

Thus it is possible to realize the liquid accommodating container that has a sufficient volume for reserving waste ink without the mixing of unused ink and non-print and can accommodate a sufficient amount of ink used in printing with space-saving, the liquid ejecting device provided therewith, and the liquid introducing method.

In the aforementioned embodiment, the ink holding member 24 is provided in the print head 20-side. However, the ink holding member 24 may be provided in the ink tank 30-side. Likewise the filter member 23 may be provided in the ink tank 30-side.

Further, for suppressing negative pressure variations in the print head 20 at the print operation to be small, the pressure in the print head 20 may be controlled through the opening 25. At the time of supplying a pressurizing force into the print head 20, the opening 25 functions as a pressurizing force introducing unit that allows introduction of the pressurizing force by introduction of gases and/or liquids, and the transfer unit 51 functions as a pressurizing force supply passage that can supply the pressurizing force. In addition, at the time of applying the suction (pressure-reducing) force in the print head 20, the opening 25 functions as a suction force introducing unit that allows introduction of the suction force by discharge of gases and/or liquids, and the transfer unit 51 functions as a suction force supply passage that can supply the suction force. The opening 25 may be provided with an introducing unit for pressurization and a discharging unit for suction separately. In addition, the pressurizing force and sucking force respectively are only required to be pressure for pressurization and pressure for depressurization in the print head 20, and are not necessarily limited to a positive pressure and a negative pressure on the basis of an atmospheric pressure.

The present invention may be applied, in addition to the full line type printing apparatus, to printing apparatuses of various print systems such as a serial scanning type printing apparatus that prints an image with transfer of a print head and a conveyance operation of a print medium.

In addition, the liquid ejecting head in the present invention may be applied, in addition to the inkjet print head that can eject ink, widely as a head for ejecting various kinds of liquids. For example, the liquid ejection head in the present invention may be used as a head for ejecting various kinds of treatment liquids or medical agents supplied in a liquid flow passage. Further, the liquid ejecting device in the present invention may be applied, in addition to the inkjet printing apparatus using the inkjet print head, widely as an apparatus for applying various kinds of treatment liquids or medical agents to a treatment member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-134817, filed Jun. 30, 2014, which is hereby incorporated by reference wherein in its entirety.

What is claimed is:

1. A liquid accommodating container that supplies a first liquid to a liquid ejecting head, the liquid accommodating container comprising:

a housing including a liquid absorbing element which holds the first liquid and a second liquid;

an introduction opening that is provided to introduce the second liquid to the liquid absorbing element; and a preventive boundary that prevents the second liquid introduced to the liquid absorbing element through the introduction opening from being mixed with the first liquid throughout a duration of supply of the first liquid to the liquid ejecting head, wherein the second liquid is comprised of a portion of the first liquid that had passed through a nozzle of the liquid ejecting head.

2. The liquid accommodating container according to claim 1, wherein a portion, in which the second liquid is to be accommodated, in the liquid absorbing element is a portion in which the first liquid, before being supplied to the liquid ejecting head, is accommodated.

3. The liquid accommodating container according to claim 1, wherein the introduction opening acts also as an air communicating opening that communicates an inside of the liquid accommodating container with the atmosphere.

4. The liquid accommodating container according to claim 1, wherein the second liquid includes a portion of the first liquid that is ejected and/or sucked from the liquid ejecting head in a recovery process for recovering an ejecting state of the liquid ejecting head.

5. The liquid accommodating container according to claim 2, wherein the introduction opening acts also as an air communicating opening that communicates an inside of the liquid accommodating container with the atmosphere, the second liquid includes a portion of the first liquid that is ejected and/or sucked from the liquid ejecting head in a recovery process for recovering an ejecting state of the liquid ejecting head, and the second liquid is introduced to the introduction opening after the recovery process is executed by a predetermined number of times from a state where the liquid accommodating container is filled with the first liquid.

6. The liquid accommodating container according to claim 2, wherein the portion of the liquid absorbing element is a portion where the air and the second liquid are mixed.

7. The liquid accommodating container according to claim 2, wherein the second liquid is absorbed in the portion of the liquid absorbing element through a needle inserted in the introduction opening.

8. The liquid accommodating container according to claim 2, wherein the preventive boundary is formed by an air layer that separates the first liquid from the second liquid in the liquid absorbing element.

9. A liquid ejecting device that supplies a first liquid in a liquid accommodating container to a liquid ejecting head and ejects the first liquid from the liquid ejecting head, the liquid ejecting device comprising:

a housing including a liquid absorbing element which holds the first liquid and a second liquid;

a guiding unit that guides the second liquid to the liquid absorbing element; and a preventive boundary that prevents the second liquid guided by the guiding unit from being mixed with the first liquid throughout a duration of supply of the first liquid to the liquid ejecting head, wherein the second liquid is comprised of a portion of the first liquid that had passed through a nozzle of the liquid ejecting head.

10. A liquid introducing method comprising the steps of:

supplying a first liquid absorbed in a liquid absorbing element provided in a housing of a liquid accommodating container to a liquid ejecting head;

introducing a second liquid to the liquid absorbing element in the housing, the second liquid comprising a portion of the first liquid having been ejected from the liquid ejecting head; and preventing the second liquid introduced to the liquid absorbing element from being mixed with the first liquid throughout a duration of supply of the first liquid to the liquid ejecting head.

11. The liquid introducing method according to claim 10, wherein the preventing step comprises introducing air to the liquid accommodating container before introducing the second liquid to the liquid accommodating container.

* * * * *